US010773126B2

(12) United States Patent
Kim et al.

(10) Patent No.: US 10,773,126 B2
(45) Date of Patent: Sep. 15, 2020

(54) BALL-PITCHING CONTROL METHOD OF PITCHING MACHINE IN BASEBALL PRACTICE SYSTEM AND BASEBALL PRACTICE SYSTEM USING THE SAME

(71) Applicant: NEWDIN CONTENTS CO., LTD., Seoul (KR)

(72) Inventors: Se Hwan Kim, Daegu (KR); Bong Kyung Ko, Daejeon (KR); Sang Hyun Joo, Daejeon (KR)

(73) Assignee: NEWDIN CONTENTS CO., LTD., Seoul (KR)

( * ) Notice: Subject to any disclaimer, the term of this patent is extended or adjusted under 35 U.S.C. 154(b) by 2 days.

(21) Appl. No.: 16/342,204

(22) PCT Filed: Oct. 18, 2017

(86) PCT No.: PCT/KR2017/011534

§ 371 (c)(1),
(2) Date: Apr. 16, 2019

(87) PCT Pub. No.: WO2018/074843

PCT Pub. Date: Apr. 26, 2018

(65) Prior Publication Data

US 2019/0321684 A1 Oct. 24, 2019

(30) Foreign Application Priority Data

Oct. 20, 2016 (KR) ..... 10-2016-0136698

(51) Int. Cl.
*A63B 69/00* (2006.01)
*A63B 69/40* (2006.01)
(Continued)

(52) U.S. Cl.
CPC ..... *A63B 24/0087* (2013.01); *A63B 69/0002* (2013.01); *A63B 69/40* (2013.01);
(Continued)

(58) Field of Classification Search
CPC ..... A63B 24/0087; A63B 69/406; A63B 69/0006; H02P 2205/07
See application file for complete search history.

(56) References Cited

U.S. PATENT DOCUMENTS 5,443,260 A 8/1995 Stewart et al.
5,464,208 A * 11/1995 Pierce ..... A63B 69/406 124/78
(Continued)

FOREIGN PATENT DOCUMENTS

KR 10-0788785 B1 12/2007
KR 10-1352606 B1 1/2014
(Continued)

OTHER PUBLICATIONS

International Search Report for PCT/KR2017/011534 dated Mar. 2, 2018 from Korean Intellectual Property Office.

*Primary Examiner* — David L Lewis
*Assistant Examiner* — Robert E Mosser
(74) *Attorney, Agent, or Firm* — Revolution IP, PLLC

(57) ABSTRACT

Disclosed are a ball-pitching control method of a pitching machine in a baseball practice system that is capable of sensing a pitched ball or a hit ball using a sensing device without using a separate sensor or measurement device and correcting the settings of the pitching machine based on the result of sensing such that the pitching machine pitches a ball at an accurate speed, and that is capable of analyzing the results periodically sensed by a sensing device and the cumulative results of set ball pitching information of the pitching machine such that the pitching machine automatically performs self-correction, thereby solving a problem in which the set speed of the ball is not accurately realized due to deterioration of the pitching machine over time or due to a change in the weight or the state of the ball, and a baseball practice system using the same.

10 Claims, 5 Drawing Sheets

(51) Int. Cl.
*A63B 24/00* (2006.01)
*A63B 102/18* (2015.01)

(52) U.S. Cl.
CPC ... *A63B 2069/0008* (2013.01); *A63B 2102/18* (2015.10); *A63B 2220/30* (2013.01); *A63B 2220/833* (2013.01)

(56) References Cited

U.S. PATENT DOCUMENTS

| | | | | |
|---|---|---|---|---|
| 10,471,330 | B1 * | 11/2019 | Hart | A63B 69/0002 |
| 2013/0319387 | A1 * | 12/2013 | Paulson | H02P 29/00 124/10 |
| 2015/0114377 | A1 | 4/2015 | Yoo | |

FOREIGN PATENT DOCUMENTS

| | | | |
|---|---|---|---|
| KR | 10-1394753 | B1 | 5/2014 |
| KR | 10-2014-0100685 | A | 8/2014 |
| KR | 10-1505931 | B1 | 3/2015 |
| KR | 10-1508523 | B1 | 4/2015 |
| KR | 10-1543371 | B1 | 8/2015 |
| KR | 10-1546666 | B1 | 8/2015 |

* cited by examiner

BALL-PITCHING CONTROL METHOD OF PITCHING MACHINE IN BASEBALL PRACTICE SYSTEM AND BASEBALL PRACTICE SYSTEM USING THE SAME

TECHNICAL FIELD

The present invention relates to a ball-pitching control method of a pitching machine in a baseball practice system that allows a user to hit, with a bat, a ball pitched by the pitching machine or a baseball practice system that allows a user to hit, with a bat, a ball pitched by the pitching machine in an indoor space of a predetermined size, senses the hit ball through a sensing device, and realizes a simulation image based on the result of sensing, such as a so-called screen baseball system, and a baseball practice system using the same.

BACKGROUND ART

With the recent increase in the number of people enjoying baseball, a baseball practice system, such as a so-called screen baseball system, has emerged, which overcomes the limitations of playing baseball in a large baseball stadium and allows people to enjoy playing a virtual baseball game while experiencing virtual reality, even in a small indoor space.

Typically, a screen baseball system is installed in an indoor space and has a batting area with a space of a predetermined size in which a user can bat and a screen capable of displaying a virtual baseball diamond. When a pitching machine installed on the back of the screen pitches a ball toward the batting area, a user who is ready to hit the ball in the batting area hits the ball pitched by the pitching machine. At this time, a sensing device senses the movement of the pitched ball and the movement of the ball hit by the user. Subsequently, based on the result of sensing, whether the pitched ball is a strike or a ball is determined, and an image simulating the trajectory of the hit ball is realized on the screen.

The pitching machine used in the baseball practice system, such as the screen baseball system, pitches balls at various pitching angles and various speeds such that a user can hit the balls pitched with various types of pitches and the balls pitched at various speeds, whereby the user may take a batting practice or may enjoy a baseball game through batting.

In the baseball practice system, it is required for the pitching machine to accurately pitch balls at set pitching angles and speeds. In the case in which the pitching machine is inclined due to the installation environment, however, it is not possible for the pitching machine to pitch a ball at an accurate pitching angle. In addition, the speeds of balls pitched by pitching machines may be different from each other due to manufacturing errors or defects in the parts constituting individual pitching machines. As a result, it is not possible to accurately control the speed of the ball pitched by the pitching machine, and it is very difficult for the pitching machine to pitch the ball with uniform accuracy.

For example, in the case in which baseball practice systems, each including a pitching machine configured to pitch balls using a wheel, are installed at sites, the pitching machines at the respective sites may pitch the balls at different speeds due to mechanical variation in the pitching machines even when the balls are pitched by the pitching machines in the state in which the rotational speeds of the wheels are the same.

In addition, the ball may be pitched by the pitching machine under conditions different from the pitching conditions set for pitching machine due to deterioration of the pitching machine over time or due to a change in the weight or the state of the ball.

The related art is disclosed in prior art documents, such as Korean Patent Application No. 10-2015-0041844, Korean Patent Application No. 10-2015-0041861, Korean Patent Application No. 10-2014-0054105, Registered U.S. Pat. No. 5,443,260, and Japanese Registered Patent No. 4743763.

DISCLOSURE

Technical Problem

It is an object of the present invention to provide a ball-pitching control method of a pitching machine in a baseball practice system that is capable of sensing a pitched ball or a hit ball using a sensing device without using a separate sensor or measurement device and correcting the settings of the pitching machine based on the result of sensing such that the pitching machine pitches a ball at an accurate speed, thereby solving a problem in which it is not possible for the pitching machine to pitch a ball at an accurate speed due to a mechanical error in the pitching machine, and a baseball practice system using the same.

It is another object of the present invention to provide a ball-pitching control method of a pitching machine in a baseball practice system that is capable of analyzing the results periodically sensed by a sensing device and the cumulative results of set ball pitching information of the pitching machine such that the pitching machine automatically performs self-correction, thereby solving a problem in which the set speed of the ball is not accurately realized due to deterioration of the pitching machine over time or due to a change in the weight or the state of the ball, and a baseball practice system using the same.

Technical Solution

In accordance with an aspect of the present invention, the above and other objects can be accomplished by the provision of a ball-pitching control method of a pitching machine in a baseball practice system including a sensing device for sensing a ball pitched toward a batting area by the pitching machine, the ball-pitching control method including calculating a ball motion model using sensing data obtained as the result of the pitching machine pitching the ball at a predetermined speed and the sensing device sensing the pitched ball, calculating the speed of the ball measured by the sensing device from the speed of the ball set for pitching machine using the calculated ball motion model, calculating a conversion function for converting the speed of the ball to be controlled into the speed of the ball to be set for pitching machine using information about the set speed of the ball and the measured speed of the ball, and converting and setting the speed of the ball to be realized by the pitching machine when a user takes a baseball practice or plays a baseball game using the conversion function, whereby the ball is pitched by the pitching machine.

In accordance with another aspect of the present invention, there is provided a ball-pitching control method of a pitching machine in a baseball practice system including a sensing device for sensing a ball pitched toward a batting area by the pitching machine, the ball-pitching control method including calculating a ball motion model using sensing data obtained as the result of the pitching machine pitching the ball at a predetermined speed and the sensing device sensing the pitched ball when a baseball practice or a baseball game is performed, and storing information about the set speed of the ball and information about the measured speed of the ball calculated based on the ball motion model, updating a conversion function for converting the speed of the ball to be controlled into the speed of the ball to be set for pitching machine using the set speed and the measured speed of the ball stored during a predetermined period, and applying the updated conversion function to the pitching machine in order to correct an error in the pitching speed of the ball that occurs in the pitching machine during the period such that the pitching machine performs self-correction.

In accordance with another aspect of the present invention, there is provided a baseball practice system including a pitching machine for pitching a ball toward a batting area, in which a user hits the ball, at a variable speed, a sensing device for sensing the ball pitched by the pitching machine and generating sensing data, and a control device for calculating a ball motion model pertaining to the pitched ball using the sensing data received from the sensing device, calculating the speed of the ball measured by the sensing device from the speed of the ball set for pitching machine using the calculated ball motion model, calculating a conversion function for converting the speed of the ball to be controlled into the speed of the ball to be set for pitching machine using information about the set speed of the ball and the measured speed of the ball, and applying the calculated conversion function to the pitching machine in order to convert and set the speed of the ball to be realized by the pitching machine when a user takes a baseball practice or plays a baseball game using the conversion function, whereby the ball is pitched by the pitching machine.

In accordance with a further aspect of the present invention, there is provided a baseball practice system including a pitching machine for pitching a ball toward a batting area, in which a user hits the ball, at a variable speed, a sensing device for sensing the ball pitched by the pitching machine and generating sensing data, and a control device for calculating a ball motion model pertaining to the pitched ball using the sensing data received from the sensing device, calculating the speed of the ball measured by the sensing device from the speed of the ball set for pitching machine using the ball motion model whenever the ball is pitched by the pitching machine, storing the calculated speed of the ball in a storage, updating a conversion function for converting the speed of the ball to be controlled into the speed of the ball to be set for pitching machine using the set speed and the measured speed of the ball stored during a predetermined period, and applying the updated conversion function to the pitching machine in order to correct an error in the pitching speed of the ball that occurs in the pitching machine during the period such that the pitching machine performs self-correction.

Advantageous Effects

A ball-pitching control method of a pitching machine in a baseball practice system according to an embodiment of the present invention and a baseball practice system using the same have effects in that it is possible to sense a pitched ball or a hit ball using a sensing device without using a separate sensor or measurement device and correcting the settings of the pitching machine based on the result of sensing such that the pitching machine accurately pitches a ball, thereby solving a problem in which it is not possible for the pitching machine to pitch a ball at an accurate speed due to a mechanical error in the pitching machine, and in that an error in the speed of the ball is corrected based on the relationship between the sensing device and the pitching machine, thereby enabling pitching machines at different sites to pitch balls with uniform accuracy.

In addition, a ball-pitching control method of a pitching machine in a baseball practice system according to another embodiment of the present invention and a baseball practice system using the same have effects in that it is possible to analyze the results periodically sensed by a sensing device and the cumulative results of set ball pitching information of the pitching machine such that the pitching machine automatically performs self-correction, thereby solving a problem in which the set speed of the ball is not accurately realized due to deterioration of the pitching machine over time or due to a change in the weight or the state of the ball, and in that it is not necessary for a manager to frequently correct the pitching machine using a separate sensor or measurement device, whereby it is possible to more efficiently operate the baseball practice system.

BEST MODE

A ball-pitching control method of a pitching machine in a baseball practice system and a baseball practice system using the same according to the present invention will be described in detail with reference to the accompanying drawings.

A "baseball practice system" according to the present invention conceptually includes both a conventional baseball practice system, in which a pitching machine pitches a ball to allow batting practice and a user hits the pitched ball in a batting area, and a virtual baseball simulation system, which is installed in an indoor space, which has a batting area with a space of a predetermined size where a user can bat and a screen capable of displaying a virtual baseball diamond, and which is operated in such a manner that, when the pitching machine pitches a ball toward the batting area, a user who is ready to hit the ball in the batting area hits the ball pitched by the pitching machine, a sensing device senses the movement of the pitched ball and the movement of the ball hit by the user, and an image simulating the trajectory of the hit ball is realized on the screen based on the result of sensing. Hereinafter, the present invention will be described in detail.

Figure 1:
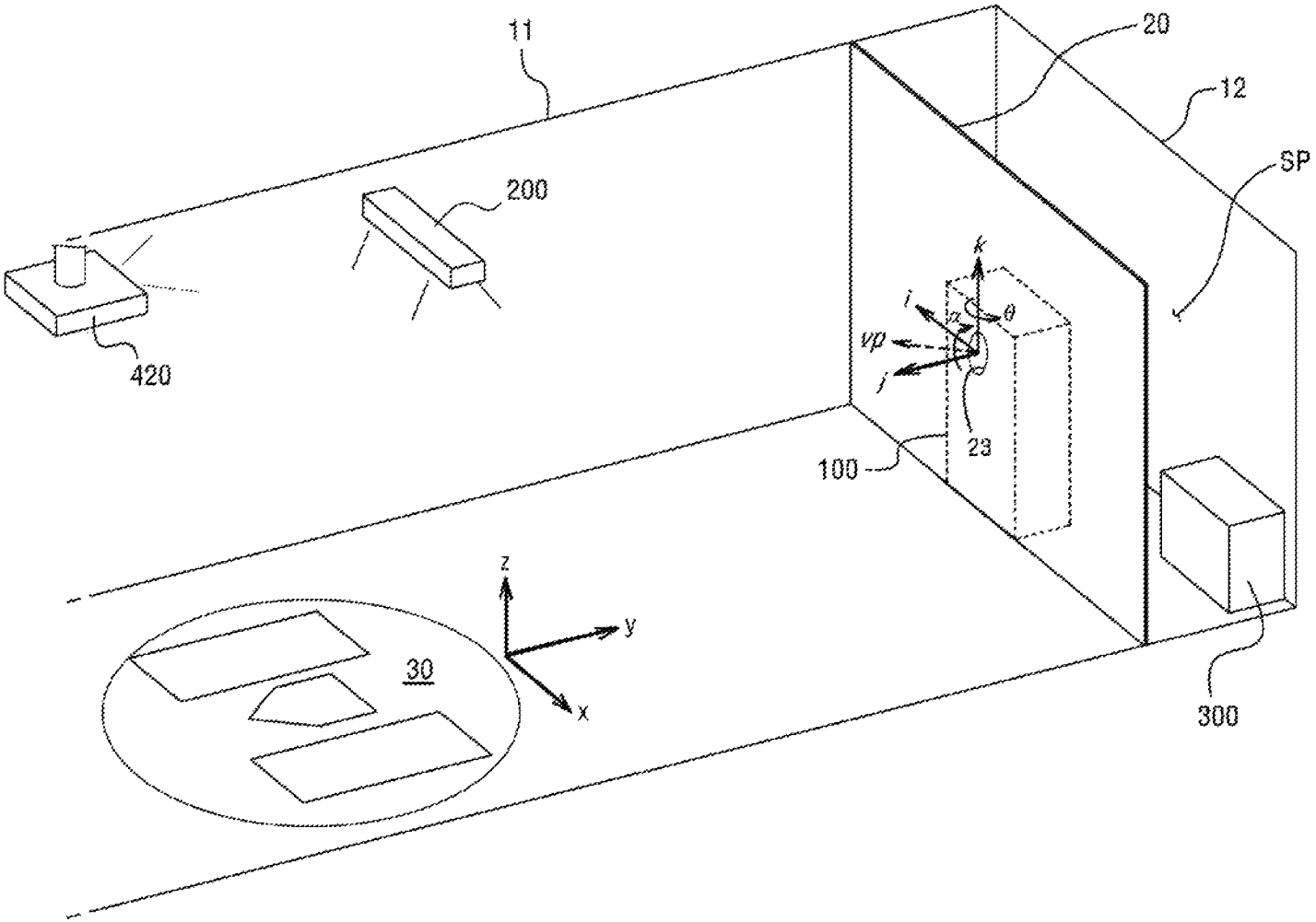
FIG. 1 is a view showing a virtual baseball simulation system, i.e. a so-called screen baseball system, which is an example of a baseball practice system according to an embodiment of the present invention.

First, a baseball practice system according to an embodiment of the present invention will be described with reference to FIGS. 1 and 2. FIG. 1 is a view showing a virtual baseball simulation system, i.e. a so-called screen baseball system, which is an example of a baseball practice system according to an embodiment of the present invention, and FIG. 2 is a block diagram showing the construction of the baseball practice system shown in FIG. 1.

In the same manner as a typical screen baseball system, as shown in FIG., a baseball practice system according to an embodiment of the present invention includes a batting area 30 and a screen 20, which are provided in a space defined by a side wall 11 and a rear wall 12, and is configured such that a user can swing and hit a ball with a bat in the batting area.

In a space SP defined between the screen 20 and the rear wall 12, a control device 300 for processing information about a baseball simulation image to be projected onto the screen 20 (the image processed by the control device 300 is projected onto the screen 20 through an image output device 420) may be provided, and a pitching machine 100 that is capable of pitching a ball 1 toward the batting area 30 may be installed. A pitching hole 23 may be formed in the screen 20 at a position corresponding to the portion of the pitching machine 100 from which the ball is pitched such that the ball 1 can pass though the pitching hole 23.

Figure 2:
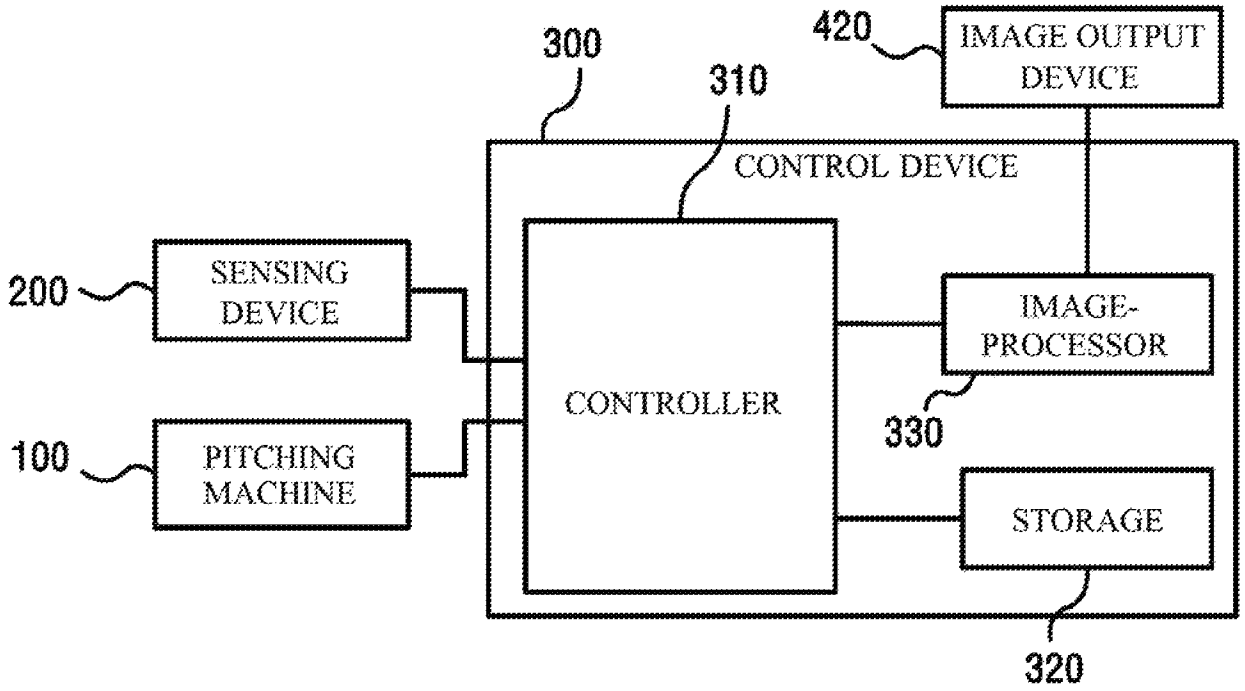
FIG. 2 is a block diagram showing the construction of the baseball practice system shown in FIG. 1.

As shown in FIGS. 1 and 2, the baseball practice system according to the embodiment of the present invention may include a control device 300, a pitching machine 100, and a sensing device 200.

The pitching machine 100 may be realized in various forms, and may include all pitching machines that are commonly used or disclosed. Basically, the pitching machine 100 may include a ball supply device, a pitching-driving device, and a pitching controller.

That is, the pitching machine is configured such that, when the ball supply device supplies balls one by one from a storage box, in which a plurality of balls is stored, to the pitching driving device, the pitching controller controls the pitching driving device based on preset pitching conditions (pitching conditions that are input manually or pitching conditions that are set while a virtual baseball simulation game is being played), and the pitching-driving device pitches a ball, supplied by the ball supply device, toward the batting area.

For example, the pitching-driving device may be realized so as to rotate a single wheel and pitch a ball placed between the wheel and a guide plate using the rotational force of the wheel (e.g. Japanese Patent Application Publication No. 2014-217468), may be realized so as to rotate two or more wheels, to locate a ball between the wheels, and to pitch the ball using the rotational force of the wheels (e.g. Korean Patent Application Publication No. 2014-0100685, Korean Registered Patent No. 0411754, and Korean Registered Utility Model No. 0269859), or may be realized so as to pitch a ball by rotating an arm holding the ball (e.g. Korean Registered Patent No. 0919371).

A pitching machine according to an embodiment of the present invention may include a pitching angle adjustment unit for moving or tilting the pitching-driving device in the upward-downward direction and/or in the leftward-rightward direction in order to adjust the direction in which a ball is pitched, i.e. a pitching angle. The pitching-driving device may be configured to adjust the speed at which a ball is pitched under the control of the pitching controller.

The pitching controller may control the pitching angle adjustment unit such that the pitching-driving device can pitch balls at set pitching angles and thus can pitch balls with various types of pitches toward the batting area, or may control the pitching-driving device such that the pitching-driving device can pitch balls at set speeds and thus can pitch balls at various speeds toward the batting area (for example, in the case in which balls are pitched using a wheel, the RPM of the wheel may be controlled in order to pitch balls at the various speeds).

That is, as shown in FIG. 1, the pitching machine according to the embodiment of the present invention may set at least one of an upward-downward pitching angle $\alpha$ or a leftward-rightward pitching angle $\theta$ based on an i-j-k coordinate system, and may pitch a ball at the set pitching angle. In addition, the pitching machine according to the embodiment of the present invention may set the speed of the ball to be pitched, and may adjust the output of the pitching-driving device or the speed of a motor such that a ball can be pitched at the set speed. Here, the above i-j-k coordinate system, which is a coordinate system based on which the pitching machine sets a pitching angle, i.e. the angle at which a ball is pitched, may be referred to as a "pitching coordinate system".

Meanwhile, the sensing device 200 may be operated in various modes. An example of the sensing device may be operated in a mode in which a plurality of optical sensor devices, each of which includes a plurality of light-emitting sensors and a plurality of light-receiving sensors, is installed in the path along which a pitched ball or a hit ball moves such that, when the ball passes by the optical sensor devices, the light-receiving sensors receive the light emitted by the light-emitting sensors and reflected by the ball, whereby each of the optical sensor devices acquires information about the coordinates of the ball in order to calculate parameters such as the speed and direction of the pitched ball or the hit ball based on the information about the coordinates of the ball.

Alternatively, the sensing device 200 may be operated in another mode in which the sensing device analyzes a captured image in order to sense an object in the image. Specifically, the sensing device 200 may acquire and analyze an image of a predetermined image-capture range including the batting area in order to calculate information about the motion of a ball pitched by the pitching machine and to calculate information about the motion of a ball hit by a user. The sensing device may be operated in the optical sensing mode and the image sensing mode in combination.

That is, a sensing device according to an embodiment of the present invention is configured to sense a ball that is pitched by the pitching machine and to calculate sensing data about the position of the ball. A ball motion model describing the trajectory of a moving ball may be calculated based on the sensing data by the sensing device or a controller, a description of which will follow.

The baseball practice system according to the embodiment of the present invention shown in FIG. 1 includes an image-sensing-type sensing device 200 including a camera and a sensing-processor. Calculation of a ball motion model based on sensing data sensed by the image-sensing-type sensing device 200 is disclosed in Korean Patent Application No. 10-2016-0004526, filed in the name of the applicant of the present application.

As disclosed in Korean Patent Application No. 10-2016-0004526, the image-sensing-type sensing device 200 may include a camera and a sensing-processor. The camera successively acquires images of a predetermined image-capture range including the batting area. The sensing-processor receives the images from the camera, performs image analysis according to predetermined conditions, analyzes the collected images to extract three-dimensional coordinate data of balls in the images, determines a ball motion model pertaining to a pitched ball or a hit ball using the extracted three-dimensional coordinate data, and calculates, using the determined ball motion model, various kinds of information necessary for a baseball practice or a baseball game using the baseball practice system.

Here, the ball motion model may be expressed by a motion equation describing the trajectory of a ball that is pitched or hit in a three-dimensional space. As shown in FIG. 1, a space in which a baseball practice or a baseball game using the baseball practice system according to the present invention is performed may be defined based on a three-dimensional coordinate system including an x-axis, a y-axis, and a z-axis such that the ball motion model can be determined based on the defined coordinate system.

The x-y-z coordinate system shown in FIG. 1 is a coordinate system based on which the sensing device senses a moving ball, and will be hereinafter referred to as a "sensing coordinate system".

In the case in which the pitching coordinate system, which is a coordinate system based on which the pitching machine pitches a ball, is rotated 180 degrees about the z-axis of the sensing coordinate system, which is a coordinate system based on which the sensing device senses a ball, the coordinate axes of the pitching coordinate system and the sensing coordinate system become parallel to each other.

The ball motion model may be defined by a motion equation in the x-axis direction, a motion equation in the y-axis direction, and a motion equation in the z-axis direction. A detailed method of calculating the ball motion model is disclosed in Korean Patent Application No. 10-2016-0004526.

Meanwhile, as shown in FIG. 2, the control device 300 may include a storage 320, an image-processor 330, and a controller 310.

The storage 320 is a unit for storing data for processing a baseball simulation image in the baseball practice system and storing information about a pitching angle that is set whenever a ball is pitched by the pitching machine and information about a ball motion model calculated whenever a ball is pitched by the pitching machine. The storage 320 may be configured to serve as a storage space for temporarily storing data received from a server (not shown).

The image-processor 330 processes image data according to a predetermined program in order to generate various kinds of baseball-simulation-related images including a background image such as an image of a virtual baseball diamond and images of players, umpires, spectators, and the like, an image of a virtual pitcher pitching a ball, and an image simulating the trajectory of a ball hit by a user. The processed image is transmitted to the image output device 420. The image output device 420 outputs the received image by, for example, projecting the received image onto the screen 20 such that the user can see the image.

The controller 310 controls each component of the baseball practice system according to the present invention and performs various operations for realizing a baseball simulation image, such as an image simulating the trajectory of a hit ball, based on various kinds of information received from the sensing device 200.

The sensing device may directly calculate the ball motion model using sensing data, or the controller 310 may calculate the ball motion model using sensing data received from the sensing device.

Hereinafter, a ball-pitching control method of the pitching machine in the baseball practice system according to the present invention will be described with reference to the flowcharts shown in FIGS. 3 and 4.

First, a ball-pitching control method of a pitching machine in a baseball practice system according to an embodiment of the present invention will be described with reference to FIG. 3.

A description will be given on the assumption that the sensing device 200 and the pitching machine 100 of the baseball practice system according to the embodiment of the present invention are installed, as shown in FIG. 1.

It is impossible to install the pitching machine 100 on a surface that is perfectly level with mathematical accuracy. For this reason, the pitching machine may be somewhat inclined depending on the environment in which the pitching machine is installed.

That is, when the pitching machine 100 pitches a ball 1 at the upward-downward pitching angle $\alpha$ and the leftward-rightward pitching angle $\theta$ based on the i-j-k coordinate system, in actuality, the ball is not pitched at the pitching angle $\alpha$ and the pitching angle $\theta$, since the pitching machine is inclined, as described above.

The inclination of the pitching machine depending on the installation environment, as described above, may be compensated for by appropriately rotating the pitching coordinate system, i.e. the i-j-k coordinate system, and may be solved by calculating a rotation matrix Rc as a compensation factor, a description of which will follow, and applying the calculated rotation matrix to the pitching machine.

The velocity of a ball that is pitched by the pitching machine may be expressed using a velocity vector, which may be expressed as speed, which is the magnitude of the velocity vector, and a direction vector, which indicates the direction of the velocity vector.

For example, when the set speed of a ball that is pitched by the pitching machine is vp, the set upward-downward pitching angle of the ball is $\alpha$, and the set leftward-rightward pitching angle of the ball is $\theta$, the actual speed, the actual upward-downward pitching angle, and the actual leftward-rightward pitching angle of the ball are different from vp, $\alpha$, and $\theta$, respectively. In the ball-pitching control method according to the present invention, the actual speed, the actual upward-downward pitching angle, and the actual leftward-rightward pitching angle of the ball are corrected based on sensing data sensed by the sensing device, and then control is performed in order to pitch the ball, whereby it is possible to accurately control the ball.

Figure 3:
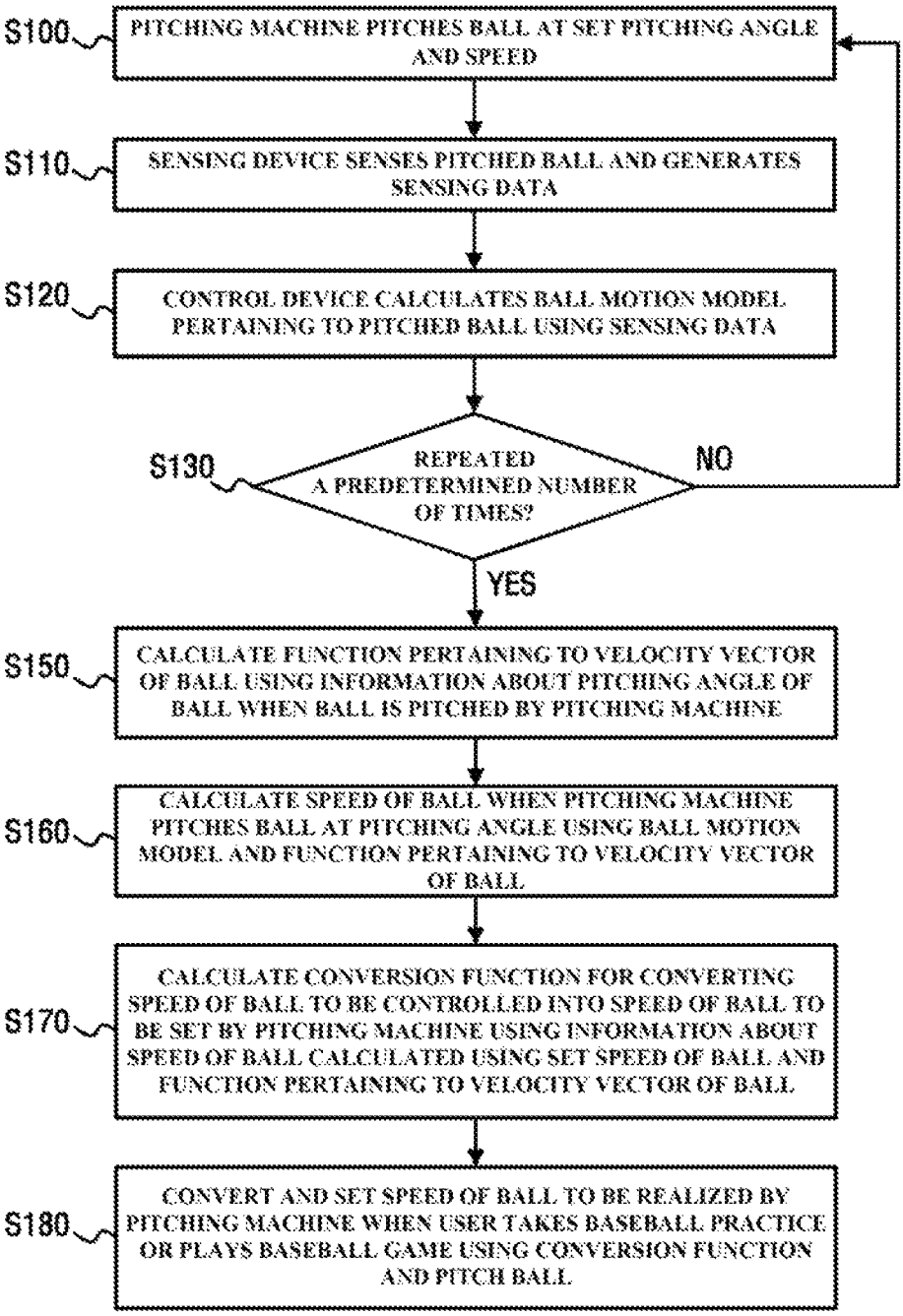
FIGS. 3 and 4 are flowcharts illustrating examples of a ball-pitching control method of a pitching machine in the baseball practice system according to the present invention.
Figure 4:
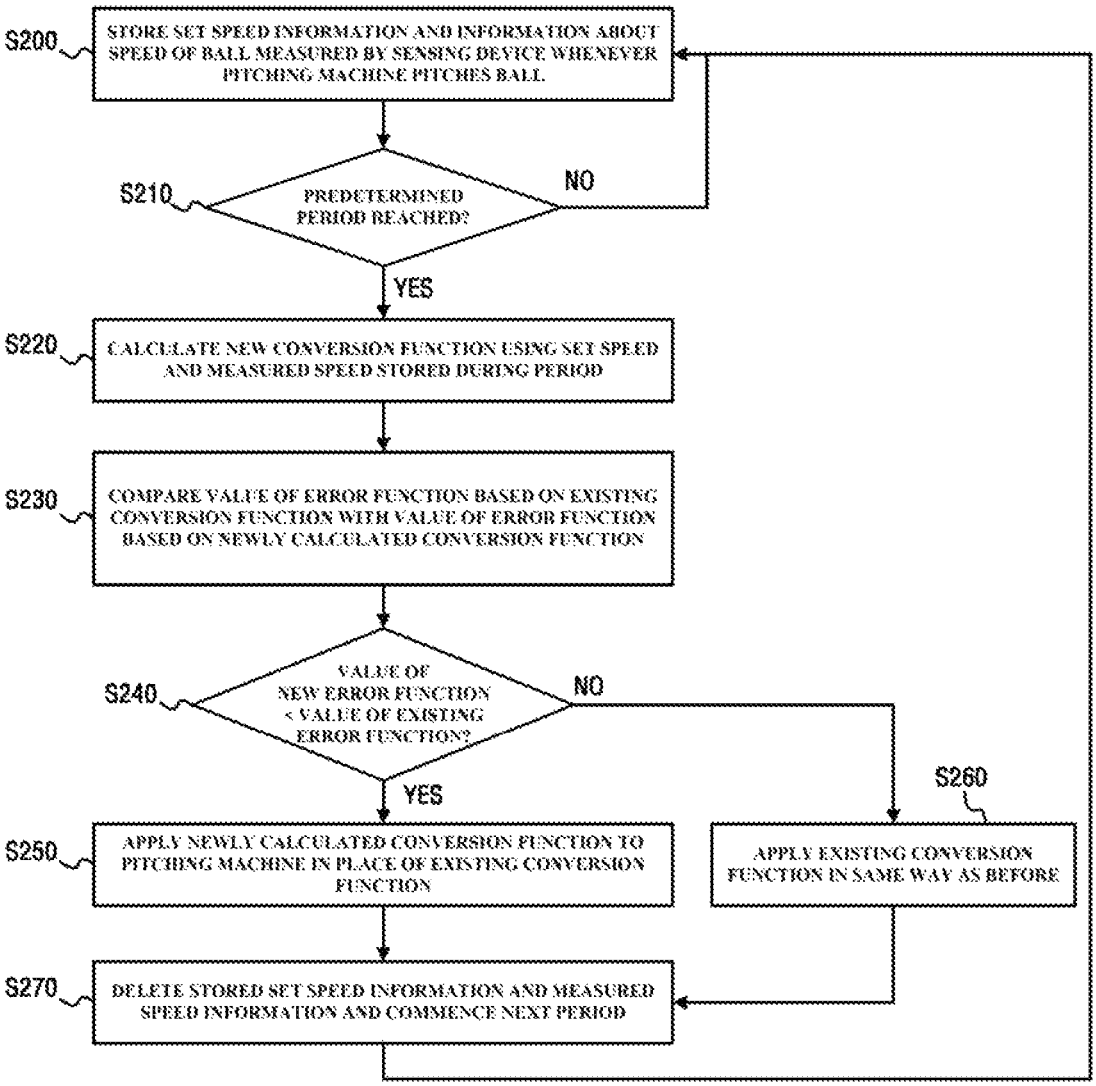

The flowchart shown in FIG. 3 shows an example of a method of the pitching machine accurately pitching a ball based on the set pitching angle and the set speed.

First, the pitching machine pitches a ball at a set pitching angle and a set speed (S100), the sensing device senses the pitched ball and generates sensing data (S110), and the control device (or the sensing device) calculates a ball motion model pertaining to the pitched ball using the sensing data (S120). The detailed method by which the sensing device or the control device calculates the ball motion model based on the sensing data is disclosed in Korean Patent Application No. 10-2016-0004526, as previously described.

According to this, the ball motion model may be calculated based on the x-y-z coordinate system. As described above, the ball motion model may be calculated using a motion equation in the x-axis direction, a motion equation in the y-axis direction, and a motion equation in the z-axis direction. Each of the following ball motion models is a function of time.

<Ball Motion Model>

$x=ax*t+bx$(a motion equation in the $x$-axis direction)

$y=ay*t+by$(a motion equation in the $y$-axis direction)

$z=az*t+bz-0.5*g*t^2$(a motion equation in the $z$-axis direction)

Here, t indicates the time value, g indicates the acceleration of gravity, x, y, and z indicate the coordinates in the respective axial directions, ax and ay indicate increments (inclinations) of the x and y coordinates, respectively, over time t, and ax and ay indicate the x and y coordinate values (intercepts), respectively, when t is 0.

In addition, az indicates the z-directional speed when t is 0, and bz indicates the z coordinate value (intercept) when t is 0.

Steps S100, S110, and S120 are repeated a predetermined number of times while the preset pitching angle is changed every time (S130). For example, the following three cases may be repeated.

Case 1—the case in which the pitching machine pitches a ball at a set upward-downward pitching angle α1, a set leftward-rightward pitching angle θ1, and a set speed vp1

Case 2—the case in which the pitching machine pitches a ball at a set upward-downward pitching angle α2, a set leftward-rightward pitching angle θ2, and a set speed vp2

Case 3—the case in which the pitching machine pitches a ball at a set upward-downward pitching angle α3, a set leftward-rightward pitching angle θ3, and a set speed vp3

Here, the upward-downward pitching angles α1, α2, and α3 are different values, the leftward-rightward pitching angles θ1, θ2, and θ3 are different values, and the speeds vp1, vp2, and vp3 are different values.

In the case in which information about the set pitching angles of the above cases is applied to the ball motion models, the following equations may be acquired.

<Case 1>

$x1=ax1*t+bx1$ $y1=ay1*t+by1$ $z1=az1*t+bz1-0.5*g*t^2$

<Case 2>

$x2=ax2*t+bx2$ $y2=ay2*t+by2$ $z2=az2*t+bz2-0.5*g*t^2$

<Case 3>

$x3=ax3*t+bx3$ $y3=ay3*t+by3$ $z3=az3*t+bz3-0.5*g*t^2$

Meanwhile, steps S100, S110, and S120 are repeated three times in order to acquire results, and a function pertaining to the velocity vector of a ball that is pitched by the pitching machine is calculated using information about the pitching angle of the ball when the ball is pitched by the pitching machine based on the acquired results (S150).

Here, the "information about the pitching angle of the ball when the ball is pitched by the pitching machine" may be information about the pitching angle of the ball in the case in which the rotation matrix Rc for compensating for inclination of the pitching machine, which was described previously, is applied. Alternatively, in the case in which only the speed of the ball is corrected while the inclination of the pitching machine is ignored, the "information about the pitching angle of the ball when the ball is pitched by the pitching machine" may be information about the pitching angle of the ball that is set in the state in which the rotation matrix Rc is not applied.

The following description will be given on the assumption that "the information about the pitching angle of the ball when the ball is pitched by the pitching machine" is information about the pitching angle of the ball in the case in which the rotation matrix Rc for compensating for inclination of the pitching machine is applied.

Figure 5:
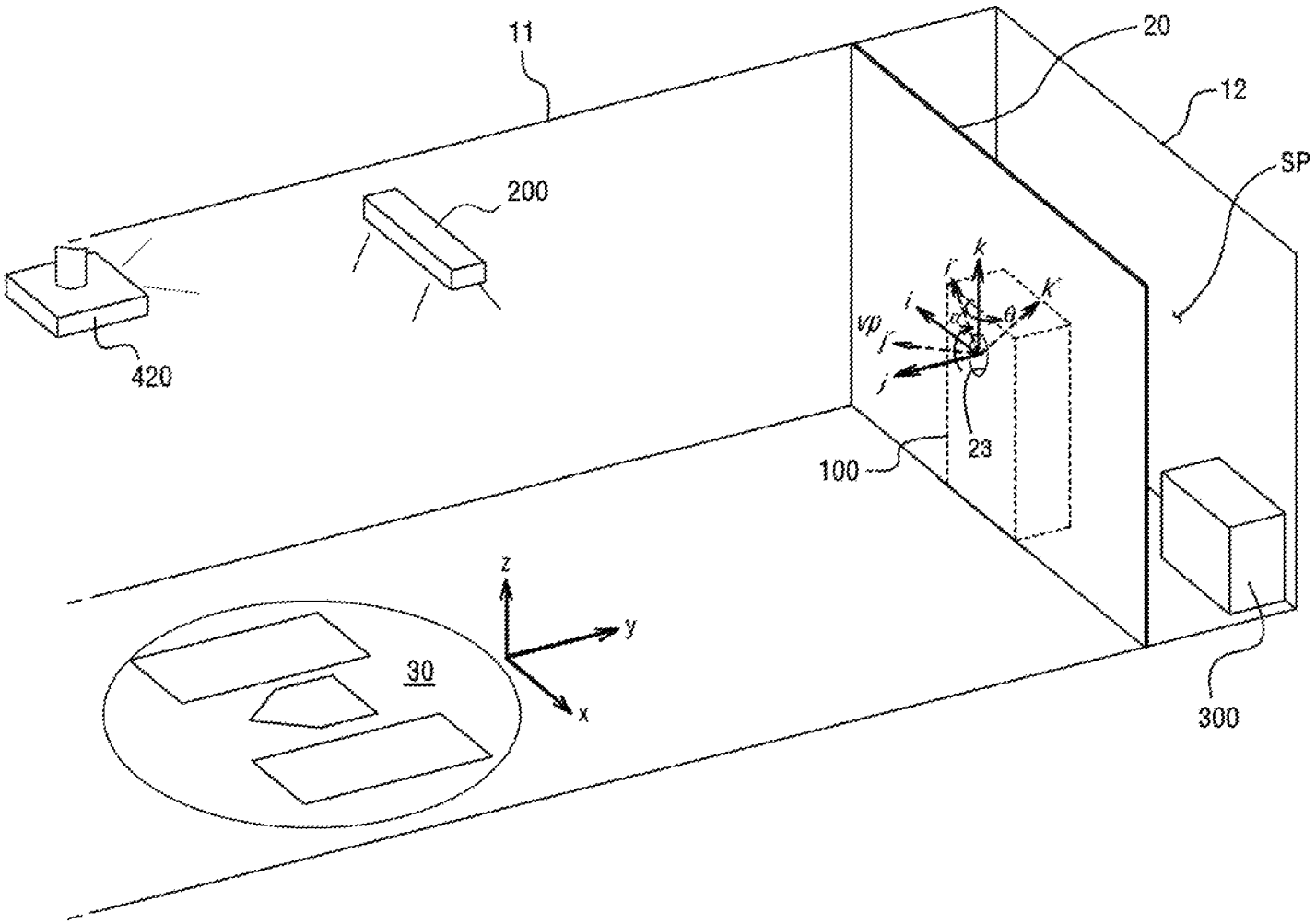
FIG. 5 is a reference view illustrating the ball-pitching control method shown in FIGS. 3 and 4.

On the assumption that the coordinate system formed when the pitching coordinate system (i, j, k) is rotated by α and θ in the upward-downward direction and the leftward-rightward direction, respectively, is (i', j', k'), as shown in FIG. 5, that the pitching machine 100 pitches a ball at the pitching angles α and θ means that the ball is pitched in the j'-axis direction in the coordinate system (i', j', k').

When the pitching machine 100 pitches a ball at a set speed vp in the j'-axis direction, the following velocity vector VR may be obtained in the sensing coordinate system, i.e. the x-y-z coordinate system, on the assumption that the actual pitching speed is vr.

<Equation of Function Describing Velocity Vector VR of Ball>

$$VR=(vr)*Rc*\begin{bmatrix}-\sin(\theta)\\ \cos(\alpha)*\cos(\theta)\\ \sin(\alpha)*\cos(\theta)\end{bmatrix}$$

In the above equation pertaining to the velocity vector VR, the rotation matrix Rc may be expressed as a matrix having rotation components of Euler angles Ψc, δc, and Φc based on the x, y, and z axes of the sensing coordinate system, respectively, as follows.

<Equation Pertaining to Rotation Matrix>

$$Rc=\begin{bmatrix}\cos(\Phi c) & -\sin(\Phi c) & 0\\ \sin(\Phi c) & \cos(\Phi c) & 0\\ 0 & 0 & 1\end{bmatrix}\begin{bmatrix}\cos(\delta c) & 0 & \sin(\delta c)\\ 0 & 1 & 0\\ -\sin(\delta c) & 0 & \cos(\delta c)\end{bmatrix}\begin{bmatrix}1 & 0 & 0\\ 0 & \cos\Psi c) & -\sin(\Psi c)\\ 0 & \sin(\Psi c) & \cos(\Psi c)\end{bmatrix}$$

The values of the rotation components Ψc, δc, and Φc of the rotation matrix Rc are values that have already been acquired using another method. In the present invention, priority is given to a method of correct the speed of the ball, rather than a method of calculating the rotation matrix in order to compensate for the pitching angle of the ball, and therefore a detailed method of calculating the rotation matrix Rc will be omitted.

As described above, the actual speed vr of the ball when the ball is pitched may be calculated using the function pertaining to the velocity vector of the ball. The speed of a ball when the pitching machine pitches the ball at a set pitching angle in the state in which the pitching machine is compensated for by the rotation matrix may be calculated using the ball motion model and the function pertaining to the velocity vector of the ball (S160).

That is, a correction factor for correcting the difference between the speed of the ball measured by the sensing device and the set speed of the pitching machine is calculated.

The <ball motion model> is a function of time t. In the case in which the y-axis motion equation y=ay*t+by is differentiated, therefore, it can be seen that the y-axis velocity component of the moving ball=ay.

On the assumption that y-axis speed component of the velocity vector VR is VR(y), it is satisfied that ay=VR(y). That is, a definition may be given as follows using the <function pertaining to the velocity vector>.

$$ay = VR(y) = vr * (Rc(2, 1) * (-\sin(\theta)) + Rc(2, 2) * \cos(\alpha) * \cos(\theta) + Rc(2, 3) * \sin(\alpha) * \cos(\theta))$$

In the case in which the equation of ay is arranged, the equation pertaining to the actual pitching speed vr may be obtained as follows.

<Equation Pertaining to Pitching Speed vr>

$$vr = \frac{ay}{(Rc(2, 1) * (-\sin(\theta)) + Rc(2, 2) * \cos(\alpha) * \cos(\theta) + Rc(2, 3) * \sin(\alpha) * \cos(\theta))}$$

Consequently, the actual pitching speed vr measured by the sensing device with respect to the set speed vp of the pitching machine may be acquired using the ay of the ball motion model, calculated by the sensing device, the rotation matrix Rc for compensating for inclination of the pitching machine, and the set upward-downward pitching angle α and leftward-rightward pitching angle θ of the pitching machine.

A conversion function for converting the speed of the ball to be controlled into the speed of the ball to be set for pitching machine may be calculated using information about the speed of the ball, calculated using the set speed of the ball and the function pertaining to the velocity vector of the ball, as described above (S170).

Obtaining data for the three cases pertaining to the set pitching angle and speed was described previously. For a greater number of cases, vr may be variously calculated using the above equation, and linear approximation, linear interpolation, or spline interpolation may be used in order to acquire a conversion function for converting the speed value of the ball to be actually controlled into the set speed of the pitching machine.

For example, in the case in which the set speed of the pitching machine is set to vp(1), vp(2), . . . , vp(n) in sequence and the ball motion model is acquired using the sensing data sensed by the sensing device for each speed of the pitching machine, values corresponding to vr(1), vr(2), . . . , vr(n) may be acquired through the above equation. In the case in which linear approximation is performed using vp(1), vp(2), . . . , vp(n) and vr(1), vr(2), . . . , vr(n), a function for acquiring the speed vp_tar to be set for pitching machine from the speed vr_tar of the ball desired to be actually controlled may be expressed as follows.

<Equation Pertaining to Conversion Function>

$$\text{vp_tar} = A * (\text{vr_tar}) + B$$

$$A = \frac{\left(\sum_{i=1}^{n} vr(i)\right) * \left(\sum_{i=1}^{n} vp(i)\right) - \left(\sum_{i=1}^{n} vr(i)\right) * \left(\sum_{i=1}^{n} vp(i) * vr(i)\right)}{n * \left(\sum_{i=1}^{n} vr(i)^2\right) - \left(\sum_{i=1}^{n} vr(i)\right)^2}$$

$$B = \frac{n * \left(\sum_{i=1}^{n} vp(i) * vr(i)\right) - \left(\sum_{i=1}^{n} vr(i)\right) * \left(\sum_{i=1}^{n} vp(i)\right)}{n * \left(\sum_{i=1}^{n} vr(i)^2\right) - \left(\sum_{i=1}^{n} vr(i)\right)^2}$$

That is, in the case in which the set speed vp and the pitching speed vr are acquired using the <equation pertaining to the pitching speed vr> n times and the set speed vp and the pitching speed vr are applied to the <equation of the conversion function>, it is possible to acquire the value of the set speed vp_tar to be set for pitching machine in order to realize the target speed vr_tar at which the ball is actually to be pitched, and the conversion function is applied to the pitching machine in order to convert and set the speed of the ball to be realized by the pitching machine when a user takes a baseball practice or plays a baseball game using the conversion function, and the ball is pitched, whereby it is possible to accurately control the pitching of the ball (S180).

Meanwhile, the <equation pertaining to the pitching speed vr> is the equation pertaining to the pitching speed vr in the case in which the rotation matrix Rc is already known. In the case in which the rotation matrix Rc is not known but the position POx, POy, and POz at which the ball is pitched by the pitching machine is known, the relationship between the set speed vp and the actual pitching speed vr may be acquired using the following method.

In the case in which the ball-pitching position POx, POy, and POz is applied to the ball motion model, the following equation is satisfied. In the following equation, tp indicates the time at which the ball is in the ball-pitching position POx, POy, and POz.

<Ball Motion Model at Ball-Pitching Position>

$$POx=ax*tp+bx$$

$$POy=ay*tp+by$$

$$POz=az*tp+bz-0.5*g*tp^2$$

The time tp when the ball is located at the ball-pitching position may be calculated as follows using the <ball motion model at the ball-pitching position>.

$$tp=(POy-by)/ay$$

In the case in which the ball motion model in differentiated at the time tp, the velocity V_po when the ball is pitched by the pitching machine may be obtained as follows.

<Equation Pertaining to Velocity when Ball is Pitched>

$$V_po(x)=ax$$

$$V_po(y)=ay$$

$$V_po(z)=az-g*tp$$

Here, V_po(x), V_po(y), and V_po(z) indicate the x-axis, y-axis, and z-axis direction components of the velocity V_po when the ball is pitched.

The velocity vector VR in the <equation of function pertaining to the velocity vector VR of the ball> is the same as the velocity V_po in the <equation pertaining to the velocity when the ball is pitched>. Consequently, the two vectors also have the same magnitude, and the following equation is satisfied.

$$|V_po| = |VR| = \left| (vr) * Rc * \begin{bmatrix} -\sin(\theta) \\ \cos(\alpha) * \cos(\theta) \\ \sin(\alpha) * \cos(\theta) \end{bmatrix} \right|$$

Here, the size of each of the matrix Rc, which indicates the direction, and $$\begin{bmatrix} -\sin(\theta) \\ \cos(\alpha) * \cos(\theta) \\ \sin(\alpha) * \cos(\theta) \end{bmatrix}$$

is 1, and therefore |VR|=|vr|=|V_po| is satisfied. In the case in which the <equation pertaining to the velocity when the ball is pitched> is applied to the above equation, the equation pertaining to the speed vr may be obtained as follows.

<Equation Pertaining to Speed Vr>

$$|vr| = \sqrt{ax^2 + ay^2 + (az - g*tp)^2}$$

Here, the time tp is a value that is acquired through tp=(POy−by)/ay.

Consequently, combinations of various values of the set speed vp and the actual speed vr may be acquired using the equation pertaining to the speed vr in order to acquire the value of the set speed vp_tar to be set for pitching machine so as to realize the target speed vr_tar at which the ball is actually to be pitched through the <equation pertaining to the conversion function>.

Meanwhile, as shown in FIG. 3, even in the case in which the conversion function is applied to the pitching machine in order to correct the speed of the ball, the set speed of the ball may not be accurately realized due to deterioration of the pitching machine over time or due to a change in the weight or the state of the ball. Consequently, the conversion function that is applied to the pitching machine may be periodically updated through the analysis of accumulated ball-pitching information in order to secure reliability in ball-pitching accuracy.

A baseball practice system according to another embodiment of the present invention is capable of more accurately changing and setting the conversion function that is applied to the pitching machine using periodically accumulated data such that the pitching machine itself can periodically correct the speed of the ball.

In the <equation pertaining to the conversion function>, the pitching machine sets the speed vr_tar to be controlled as vp_tar. Over time, the speed vr of the ball pitched by the pitching machine, which is sensed using the sensing device, may become gradually different from the target speed vr_tar. As previously described, the speed of the ball is the speed of the ball when the ball is pitched by the pitching machine.

Whenever the pitching machine pitches a ball during a baseball practice or a baseball game, therefore, information about the set speed vp (the set speed vp, which is set for pitching machine in the state in which the conversion function has already been calculated and applied, becomes the value of vp_tar set for the target speed vr_tar to be controlled according to the conversion function, which has already been applied) and the speed vr of the ball that is measured by the sensing device (this may be the same value as vr_tar but may gradually become different from vr_tar due to errors) is continuously stored (S200).

When a predetermined period is reached (S210), the control device applies information about the set speed stored during the period and information about the speed measured by the sensing device to the equation of the conversion function as vp' substituting for vp and vr' substituting for vr in order to calculate coefficients A_new and B_new of a new conversion function and thus to calculate the following new conversion function from the existing conversion function (S220).

<Equation Pertaining to Newly Calculated Conversion Function>

$$vp_tar_new = A_new * (vr_tar) + B_new$$

$$A_new = \frac{\left(\sum_{i=1}^{k} vr'(i)\right) * \left(\sum_{i=1}^{k} vp'(i)\right) - \left(\sum_{i=1}^{k} vr'(i)\right) * \left(\sum_{i=1}^{k} vp'(i) * vr'(i)\right)}{k * \left(\sum_{i=1}^{k} vr'(i)^2\right) - \left(\sum_{i=1}^{k} vr'(i)\right)^2}$$

$$B_new = \frac{k * \left(\sum_{i=1}^{k} vp'(i) * vr'(i)\right) - \left(\sum_{i=1}^{k} vr'(i)\right) * \left(\sum_{i=1}^{k} vp'(i)\right)}{k * \left(\sum_{i=1}^{k} vr'(i)^2\right) - \left(\sum_{i=1}^{k} vr'(i)\right)^2}$$

In the <equation pertaining to the newly calculated conversion function>, vp□ and vr□ may be information about the set speed that is cumulatively stored in the storage during the period and information about the measured speed, which is calculated by the ball motion model when the ball is pitched at the set speed, respectively.

Here, (i) is attached to each element in order to indicate that there is a plurality of data for each element. That is, i may be 1, 2, 3 . . . , and, for example, vp'(1)=5 m/s, vp'(2)=5.5 m/s, vp'(3)=6.5 m/s . . . . Hereinafter, elements having (i) attached thereto have the same meaning as above.

On the assumption that information about the set speed stored during a predetermined period is vp_set and that information about the measured speed is vr_set, vp□(i) and vr□(i) may mean vp_set and vr_set, respectively. In order to improve the accuracy of the coefficients A_new and B_new of the newly calculated conversion function and reliability in the calculation thereof, however, vp□(i) and vr□(i) may become data obtained by appropriately processing vp_set and vr_set, respectively.

For example, in order to improve the reliability of data, data that are not duplicated a predetermined number of times may be removed from vp_set, and data corresponding thereto may be removed from vr_set.

In the case in which the distance between data is too small in vp_set, data within a predetermined distance may be collected in order to calculate and apply a representative value. In this way, data processing may be performed. In the case in which the distance between data is too large in vp_set, an intermediate value may be calculated through interpolation and may then be applied. In this way, data processing may be performed.

In the case in which vp□(i) and vr□(i), ultimately determined after data processing is performed according to predetermined conditions, as described above, are used, it is possible to calculate a new conversion function having new coefficients A_new and B_new applied thereto through the <equation pertaining to the newly calculated conversion function>.

In the case in which the newly calculated conversion function is more accurate than the existing conversion function, update may be performed so as to replace the existing conversion function with the newly calculated conversion function.

To this end, an error function is preset, the value of the error function based on the existing conversion function (hereinafter, referred to as a "value of the existing error function") and the value of the error function based on the newly calculated conversion function (hereinafter, referred to as a "value of the new error function") are compared with each other, and when the value of the error function based on the newly calculated conversion function is smaller, which means that the newly calculated conversion function is more accurate, the newly calculated conversion function is applied to the pitching machine in place of the existing conversion function (S230 to S250).

On the assumption that the existing error function for calculating the existing error value is E1 and the new error function for calculating the new error value of is E2, E1 and E2 may be expressed as follows.

$$E1(i)=|vp_tar(i)-vr_tar(i)|$$

$$E2(i)=|vp_tar_\mathrm{new}(i)-vr_tar(i)|$$

It is assumed that vp_tar(i)=A*(vr_tar(i))*B in the existing conversion function and that vp_tar_new(i)=A_new*(vr_tar(i))*B in the newly calculated conversion function. That is, vp_tar(i) is information about the set speed that is already applied to the pitching machine, and vp_tar_new(i) is information calculated using the newly calculated conversion function.

Since vp_tar(i) is a speed value set according to the existing conversion function during the period, vp_tar(i) may become the same value as the value of vp(i) or vp'(i) stored during the period. The actually measured speed value vr'(i) is already applied to A_new and B_new.

It is assumed that the sum of all values of E1(i) is the value of the existing error function and that the sum of all values of E2(i) is the value of the new error function. In the case in which the value of the new error function, which is the sum of all values of E2(i), is smaller than the value of the existing error function, which is the sum of all values of E1(i), it is possible to improve reliability because the conversion function including the newly calculated A_new and B_new is considered as a more accurate conversion function.

In the case in which the value of the new error function is smaller than the value of the existing error function, as described above, the new conversion function is applied to the pitching machine in place of the existing conversion function in order to update the conversion function (S250).

In the case in which the value of the existing error function is smaller than the value of the new error function, on the other hand, the new conversion function is deleted and the existing conversion function is applied in the same way as before (S260).

When the update of the conversion function is completed, as described above, all data stored during the period are deleted, and the next period is commenced in order to repeat steps S200 to S260 (S270).

As described above, a conversion function, which is capable of correcting the speed of the pitching machine, is preset, ball-pitching information is periodically stored and analyzed in order to calculate a new conversion function, and the preset conversion function is updated using the same. Consequently, the pitching machine is capable of performing self-correction using the sensing device over time without the bother of a manager frequently performing separate correction work, whereby it is possible to improve reliability in ball control accuracy.

INDUSTRIAL APPLICABILITY

The ball-pitching control method of the pitching machine in the baseball practice system and the baseball practice system using the same according to the present invention are industrially applicable in a technical field that allows a user to perform a baseball practice or play a virtual baseball game in such a manner that the user, with a bat, hits a ball pitched by the pitching machine in an indoor space of a predetermined size, and the sensing device senses the hit ball and realizes a simulation image on the screen in front of the user.

The invention claimed is:

1. A ball-pitching control method of a pitching machine in a baseball practice system comprising a sensing device for sensing a ball pitched toward a batting area by the pitching machine, the ball-pitching control method comprising:

calculating a ball motion model using sensing data obtained as a result of the pitching machine pitching the ball at a predetermined speed and the sensing device sensing the pitched ball;

calculating a speed of the ball measured by the sensing device from the speed of the ball set for pitching machine using the calculated ball motion model;

calculating a conversion function for converting the speed of the ball to be controlled into the speed of the ball to be set for pitching machine using information about the set speed of the ball and the measured speed of the ball; and converting and setting the speed of the ball to be realized by the pitching machine when a user takes a baseball practice or plays a baseball game using the conversion function, whereby the ball is pitched by the pitching machine, wherein the step of calculating the speed of the ball measured by the sensing device comprises:

calculating a function pertaining to a velocity vector of the ball using information about a pitching angle of the ball when the ball is pitched by the pitching machine; and calculating the speed of the ball when the pitching machine pitches the ball at the pitching angle using the ball motion model based on the sensing data and the function pertaining to the velocity vector of the ball.

2. The ball-pitching control method according to claim 1, wherein the information about the pitching angle of the ball when the ball is pitched is information obtained by applying, to information about the pitching angle of the ball preset for pitching machine, a compensation factor for compensating for a degree of inclination of a pitching coordinate system, which is a coordinate system based on which the pitching machine pitches the ball based on a sensing coordinate system, which is a coordinate system based on which the sensing device senses the ball, using a difference in the calculated ball motion model, and the step of calculating the function pertaining to the velocity vector of the ball comprises calculating a function pertaining to a velocity vector of the ball having the information about the pitching angle of the ball when the ball is pitched as a direction of the velocity and the speed of the ball as a magnitude of the velocity.

3. The ball-pitching control method according to claim 1, wherein the step of calculating the conversion function comprises:

calculating speeds calculated from a plurality of different set speeds of the pitching machine using the calculated function pertaining to the velocity vector of the ball; and calculating a conversion function for converting the speed of the ball to be controlled into the speed of the ball to be set for pitching machine through one of linear approximation, linear interpolation, and spline interpolation using the different set speed values and speed values calculated using the function pertaining to the velocity vector of the ball so as to correspond to the respective set speeds.

4. The ball-pitching control method according to claim 1, wherein the step of calculating the speed of the ball measured by the sensing device comprises applying information about a ball-pitching position at the pitching machine to the ball motion model based on the sensing data in order to calculate the speed of the ball when the ball is pitched by the pitching machine.

5. The ball-pitching control method according to claim 1, further comprising:

storing information about the speed of the ball set for pitching machine and information about the speed of the ball measured by the sensing device whenever the ball is pitched by the pitching machine; and periodically correcting an error in the pitching speed of the ball that occurs in the pitching machine during the period using the stored information about the set speed of the ball and the stored information about the measured speed of the ball or using information obtained by processing the stored information according to predetermined conditions such that the pitching machine periodically performs self-correction.

6. The ball-pitching control method according to claim 5, wherein the step of performing self-correction comprises:

calculating a coefficient of the conversion function using the set speed and the measured speed of the ball stored during a predetermined period; and comparing a value of an existing error function, calculated from an error in the speed of the ball when the ball is pitched by the pitching machine based on a calculated and applied existing conversion function using a predetermined error function, with a value of a new error function calculated from an error in the speed of the ball when the ball is pitched by the pitching machine based on a conversion function having a newly calculated coefficient applied thereto using the error function, and, in a case in which the value of the new error function is smaller than the value of the existing error function, applying the conversion function having the newly calculated coefficient applied thereto to the pitching machine.

7. A baseball practice system comprising:

a pitching machine for pitching a ball toward a batting area, in which a user hits the ball, at a variable speed;

a sensing device for sensing the ball pitched by the pitching machine and generating sensing data; and a control device for calculating a ball motion model pertaining to the pitched ball using the sensing data received from the sensing device, calculating a speed of the ball measured by the sensing device from the speed of the ball set for pitching machine using the calculated ball motion model, calculating a conversion function for converting the speed of the ball to be controlled into the speed of the ball to be set for pitching machine using information about the set speed of the ball and the measured speed of the ball, and applying the calculated conversion function to the pitching machine in order to convert and set the speed of the ball to be realized by the pitching machine when a user takes a baseball practice or plays a baseball game using the conversion function, whereby the ball is pitched by the pitching machine, wherein the control device is configured to calculate a function pertaining to a velocity vector of the ball using information about a pitching angle of the ball when the ball is pitched by the pitching machine and to calculate the speed of the ball when the pitching machine pitches the ball at the pitching angle using the ball motion model based on the sensing data and the function pertaining to the velocity vector of the ball.

8. The baseball practice system according to claim 7, wherein the control device is configured to apply information about a ball-pitching position at the pitching machine to the ball motion model based on the sensing data in order to calculate the speed of the ball when the ball is pitched by the pitching machine.

9. The baseball practice system according to claim 7, wherein the control device is configured to store information about the speed of the ball set for pitching machine and information about the speed of the ball measured by the sensing device in a storage whenever the ball is pitched by the pitching machine and to periodically correct an error in the pitching speed of the ball that occurs in the pitching machine during the period using the stored information about the set speed of the ball and the stored information about the measured speed of the ball or using information obtained by processing the stored information according to predetermined conditions such that the pitching machine periodically performs self-correction.

10. A baseball practice system comprising:

a pitching machine for pitching a ball toward a batting area, in which a user hits the ball, at a variable speed;

a sensing device for sensing the ball pitched by the pitching machine and generating sensing data; and a control device for calculating a ball motion model pertaining to the pitched ball using the sensing data received from the sensing device, calculating the speed of the ball measured by the sensing device from the speed of the ball set for pitching machine using the ball motion model whenever the ball is pitched by the pitching machine, storing the calculated speed of the ball in a storage, updating a conversion function for converting the speed of the ball to be controlled into the speed of the ball to be set for pitching machine using the set speed and the measured speed of the ball stored during a predetermined period, and applying the updated conversion function to the pitching machine in order to correct an error in the pitching speed of the ball that occurs in the pitching machine during the period such that the pitching machine performs self-correction.

* * * * *